US011077695B2

(12) United States Patent
Yamada et al.

(10) Patent No.: US 11,077,695 B2
(45) Date of Patent: Aug. 3, 2021

(54) METHOD FOR PROCESSING A SHEET, BOOKBINDING METHOD, AND BOOKBINDING ARTICLE

(71) Applicant: CANON KABUSHIKI KAISHA, Tokyo (JP)

(72) Inventors: Ryota Yamada, Chiba (JP); Shinya Miura, Kawaguchi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/880,784

(22) Filed: May 21, 2020

(65) Prior Publication Data

US 2020/0369066 A1 Nov. 26, 2020

(30) Foreign Application Priority Data

May 24, 2019 (JP) ..... JP2019-097663
Mar. 13, 2020 (JP) ..... JP2020-044257

(51) Int. Cl.

| | |
|---|---|
| ***B42C 9/00*** | (2006.01) |
| ***B42C 19/02*** | (2006.01) |
| ***B42D 1/08*** | (2006.01) |
| ***B42C 5/04*** | (2006.01) |
| ***B42C 19/08*** | (2006.01) |
| ***B42D 1/00*** | (2006.01) |
| ***B42C 11/00*** | (2006.01) |
| ***B42C 5/00*** | (2006.01) |

(52) U.S. Cl.
CPC ..... *B42C 9/0081* (2013.01); *B42C 19/02* (2013.01); *B42D 1/08* (2013.01)

(58) Field of Classification Search
CPC ..... B42C 9/0081; B42C 19/02; B42C 5/04; B42C 9/00; B42D 1/08
USPC ..... 412/1, 6, 7, 8, 33, 37, 38
See application file for complete search history.

(56) References Cited

U.S. PATENT DOCUMENTS

2014/0308093 A1 10/2014 Ishikawa et al.
2016/0144651 A1* 5/2016 Springmann ..... B42D 13/00 412/6

FOREIGN PATENT DOCUMENTS

JP 6128923 B2 5/2017
WO 2016/184655 A1 11/2016

* cited by examiner

*Primary Examiner* — Justin V Lewis
(74) *Attorney, Agent, or Firm* — Canon U.S.A., Inc. I.P. Division

(57) ABSTRACT

A method for processing a sheet for bookbinding includes operations. A cut is formed that divides a thickness of the sheet in a binding-side side surface of the sheet. A portion of a connection piece that is attached to the sheet is inserted into the cut as an inserted portion, and functions as a hinge in a book-bound state. The portion of the connection piece inserted into the cut is joined to the sheet.

18 Claims, 8 Drawing Sheets

METHOD FOR PROCESSING A SHEET, BOOKBINDING METHOD, AND BOOKBINDING ARTICLE

BACKGROUND

Field

The present disclosure relates to a method for processing a sheet, a bookbinding method, and a bookbinding article.

Description of the Related Art

A method of creating a photo album by bookbinding printed sheets is known. The specification of Japanese Patent No. 6128923 discloses a bookbinding method that cuts a sheet into a portion on which an image has been printed and a binding margin portion, separating and taping both portions together, and bundling the binding margin portion. Since a portion of tape connecting both portions serves as a flexible hinge that is easily bent, when a created bookbinding article is opened, facing pages open flat. Therefore, a viewer can view a photograph or an illustration over two pages without significant discomfort.

In the method mentioned in the specification of Japanese Patent No. 6128923, a tape is visually recognized to overlap with the print image on a binding-side sheet surface. Therefore, the viewer may feel the difference between the surface property of the print image and the surface property of the tape as a visual discomfort. For example, a visual discomfort may be felt from even a one-page print image on the binding margin side. Additionally, for example, in the case of a print image over two facing pages, a visual discomfort may be felt regarding the continuity of a photograph or an illustration. In addition, in the case of an image over facing pages, when a bookbinding article is opened, if a tape forming the binding margin portion is visually recognized near the boundary of both pages, a photograph or an illustration may be visually recognized in an intermittent manner, and the sense of unity of the image may be damaged.

SUMMARY

Information in the present disclosure discloses a bookbinding article and a method for processing a sheet with which a tape is not visually recognized to overlap with a print image. Additionally, the information also discloses a bookbinding article and a method for processing a sheet that can improve the visual continuity and the sense of unity of two facing pages.

According to an aspect of the present disclosure, a method for processing a sheet for bookbinding includes forming a cut that divides a thickness of the sheet in a binding-side side surface of the sheet, inserting, into the cut and as an inserted portion, a portion of a connection piece that is attached to the sheet, and functions as a hinge in a book-bound state, and joining the portion of the connection piece inserted into the cut to the sheet.

Further features of the present disclosure will become apparent from the following description of exemplary embodiments with reference to the attached drawings.

DESCRIPTION OF THE EMBODIMENTS

Preferred embodiments of the present disclosure will now be described in detail in accordance with the accompanying drawings. Each of the embodiments of the present disclosure described below can be implemented solely or as a combination of a plurality of the embodiments. In addition, features from different embodiments can be combined where necessary or where the combination of elements or features from individual embodiments in a single embodiment is beneficial.

Hereinafter, the present disclosure will be described in more detail with embodiments and examples. The present disclosure is not limited in any way by the following embodiments and examples unless they do not exceed the gist of the present disclosure.

First Embodiment

Figure 1A:
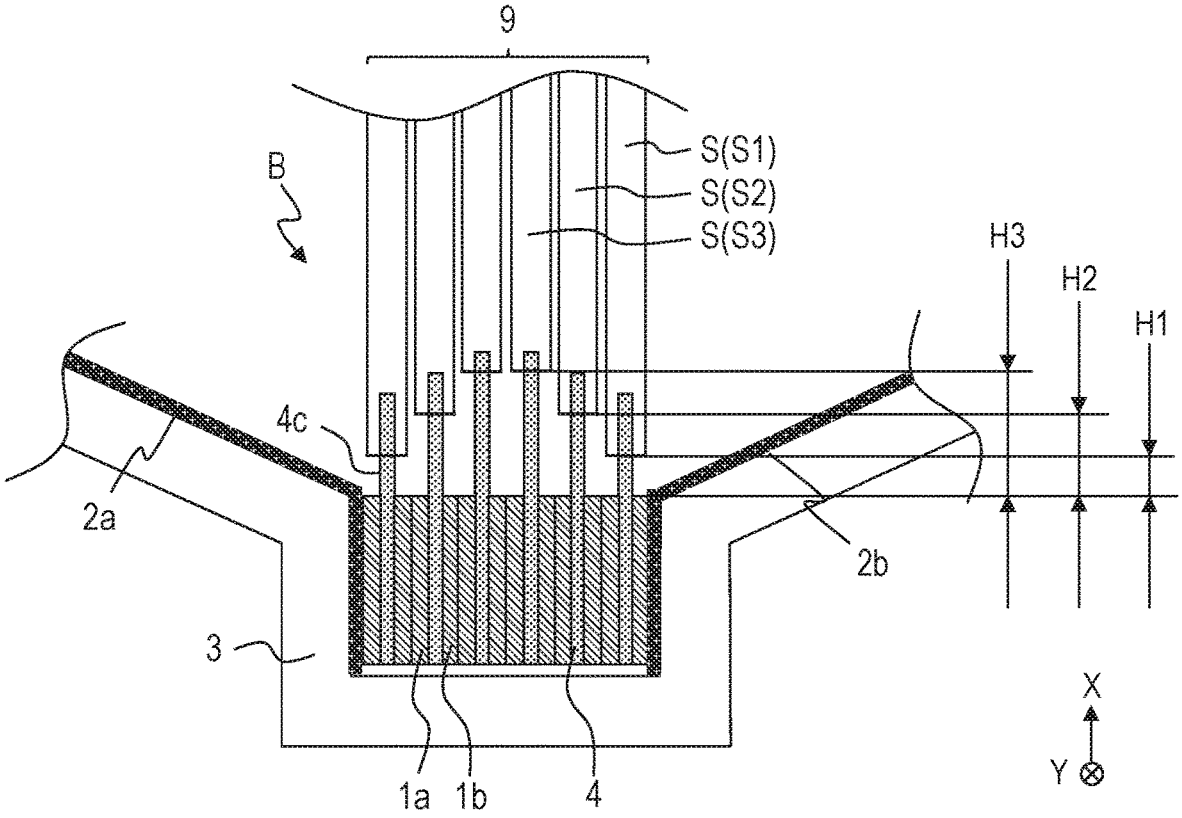
FIG. 1A is a configuration schematic diagram of a bookbinding article according to a first embodiment of the present disclosure.
Figure 1B:
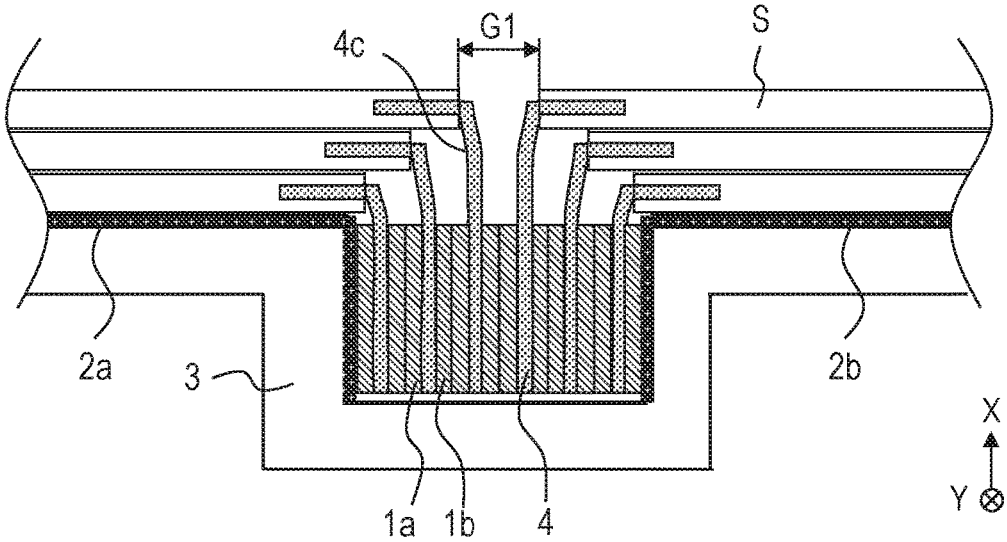
FIG. 1B is a configuration schematic diagram of the bookbinding article according to the first embodiment of the present disclosure.
Figure 2A:
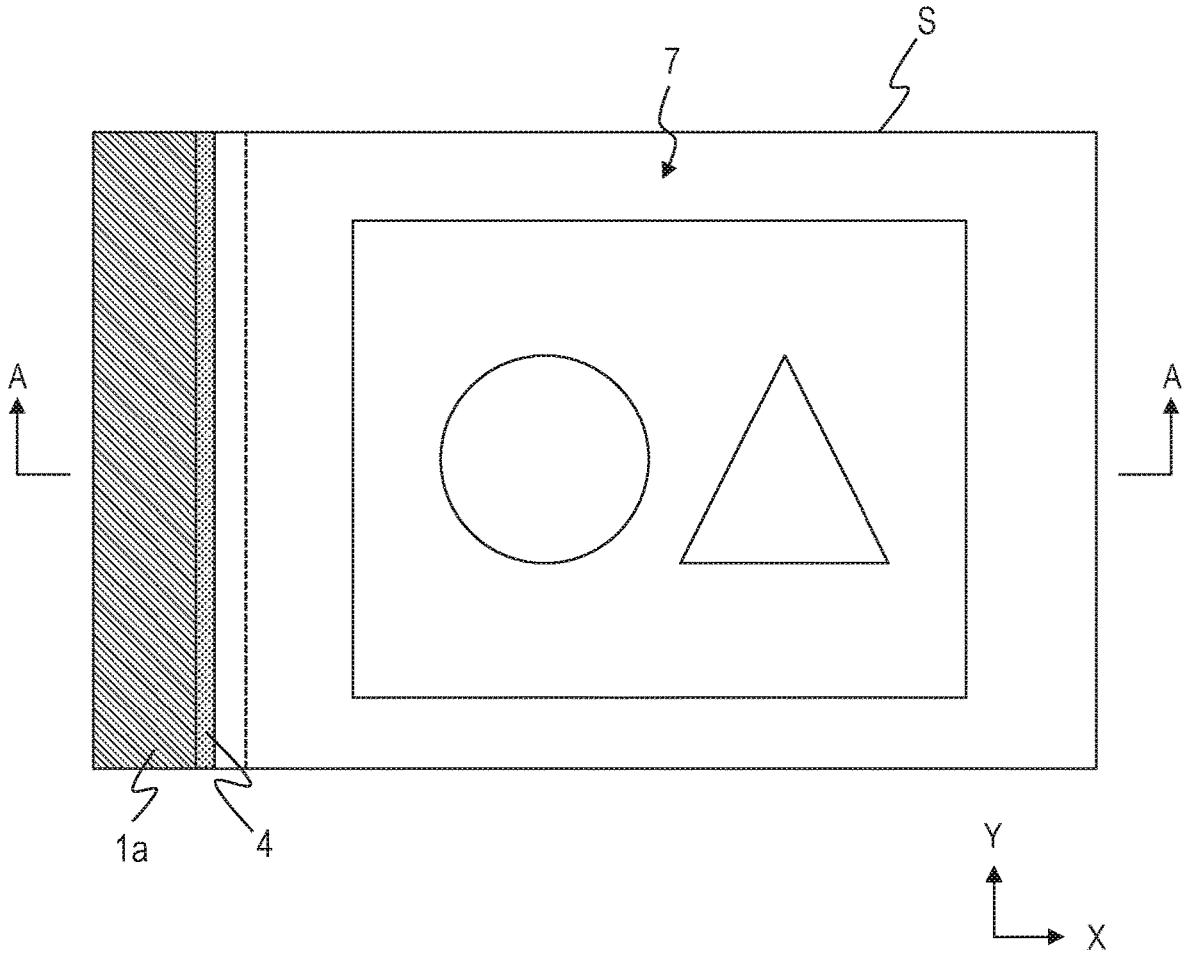
FIG. 2A is a configuration schematic diagram of a sheet constituting the bookbinding article illustrated in FIG. 1A and FIG. 1B.
Figure 2B:
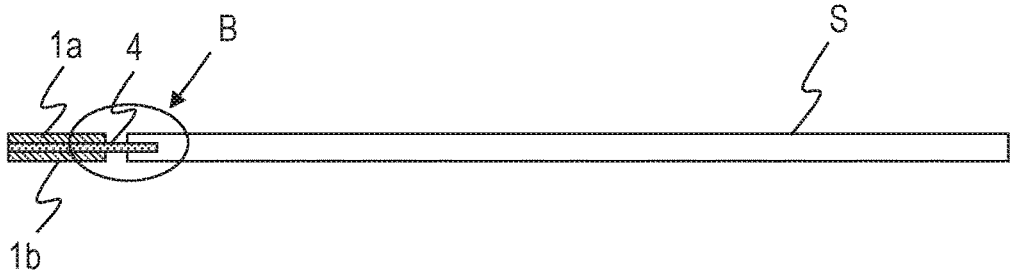
FIG. 2B is a configuration schematic diagram of the sheet constituting the bookbinding article illustrated in FIG. 1A and FIG. 1B.
Figure 3A:
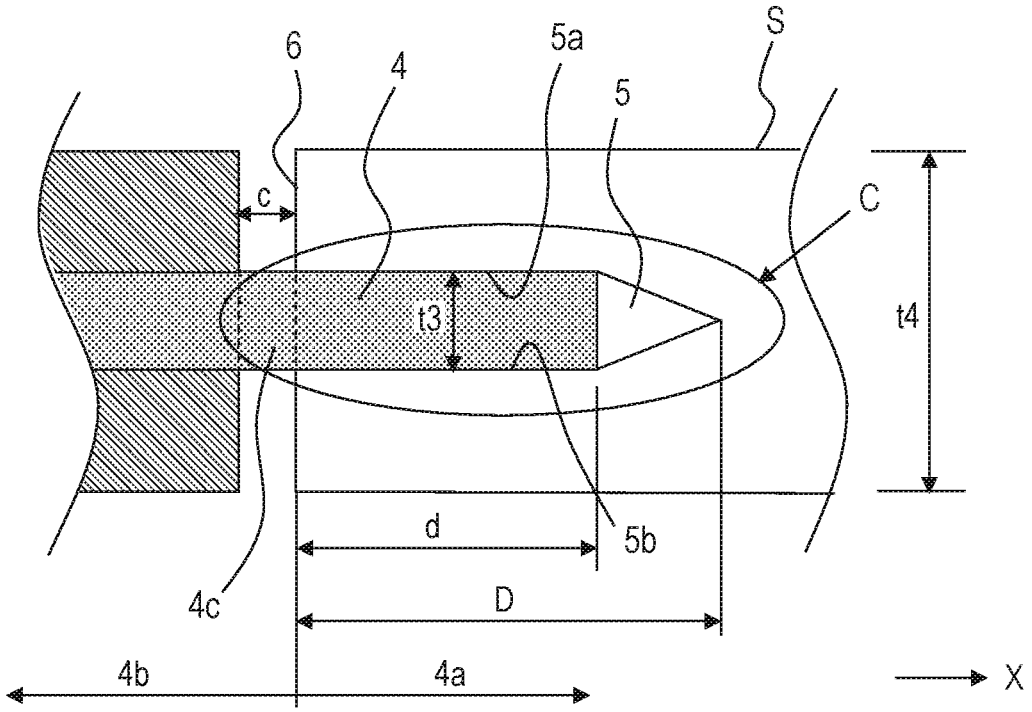
FIG. 3A is a partial enlarged view of the sheet illustrated in FIG. 1A and FIG. 1B.
Figure 3B:
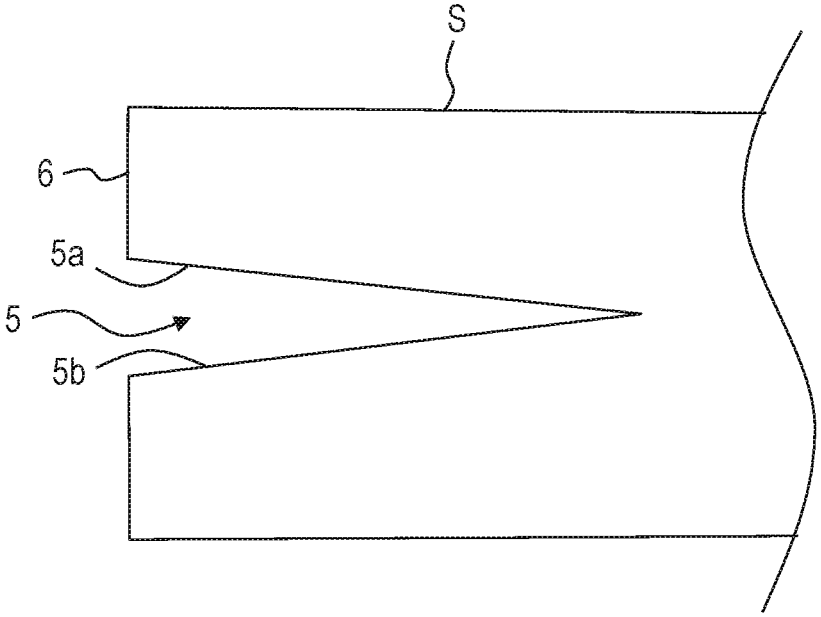
FIG. 3B is a partial enlarged view of the sheet illustrated in FIG. 1A and FIG. 1B.

A first embodiment of the present disclosure will be described. FIG. 1A and FIG. 1B are cross-sectional views of a bookbinding article B according to the first embodiment of the present disclosure, FIG. 1A illustrates the state where a sheet portion of the bookbinding article B is closed, and FIG. 1B illustrates the state where the sheet portion of the bookbinding article B is opened. FIG. 2A and FIG. 2B are configuration schematic diagrams of each sheet S constituting the bookbinding article B, FIG. 2A illustrates a plan view, and FIG. 2B illustrates a cross-sectional view taken along the A-A line in FIG. 2A. FIG. 3A is an enlarged view of a portion B in FIG. 2B, and schematically illustrates the sheet S provided with a cut 5, a connection piece 4 one portion of which is inserted into the cut 5, and spacers 1*a* and 1*b* joined to the other portion of the connection piece 4. FIG. 3B schematically illustrates the cut 5 of the sheet S before the connection piece 4 is inserted, as an enlarged view of a portion C in FIG. 3A. In the following description, the short side direction of the connection piece 4 may be called the width direction or the X direction, and the length in the short side direction of the connection piece 4 may be called the width. Additionally, the long side direction of the connection piece 4 may be called the Y direction.

The bookbinding article B includes a plurality of sheets S, connection pieces 4 joined to the sheets S, spacers 1*a* and 1*b* joined to both surfaces of the connection pieces 4, endpapers 2*a* and 2*b*, and a cover 3. The plurality of connection piece 4 and the plurality of spacers 1*a* and 1*b* are bundled with the endpapers 2*a* and 2*b* by a method such as thread binding, staple binding, and join fixing, and are fixed inside the cover 3. Although the bookbinding article B of the present embodiment includes 6 sheets S, the number of the sheets S is not limited. Although the sheets S are paper sheets, various materials used for a bookbinding, such as plastics, textiles, and nonwoven fabrics, can be used. However, the thickness of the sheet S can be 200 μm or more, since cut processing described below is performed. An image 7, such as a photograph and an illustration, is printed on both surfaces of the sheet S.

In a binding-side side surface 6 of the sheet S, a slit-shaped cut 5 is formed over the entire length in the Y direction of the side surface 6 with a predetermined depth D, so as to divide the thickness of the sheet S. As illustrated in FIG. 3B, the cut 5 has a generally triangle shape or tapered shape in which the size in the thickness direction is decreased with the distance from the side surface 6. A part of one connection piece 4 in the X direction is inserted into the cut 5 of each sheet S. The plurality of sheets S are bound via the connection pieces 4. The connection piece 4 is a generally rectangular plate-like piece having a uniform thickness, and including long sides of the almost same length as the entire length of the side surface 6 in which the cut 5 of the sheet S is formed, and shorter sides shorter than the long sides. One portion of the connection piece 4 in the width direction inserted into the cut 5 is called an insertion part 4*a*, and the other portion of the connection piece 4 in the width direction not inserted into the cut 5 is called a non-insertion part 4*b*. The connection piece 4 is a so-called double-sided tape having adhesive property on its both surfaces. The insertion part 4*a* of the connection piece 4 is joined to the sheet S, more specifically, cut surfaces 5*a* and 5*b* of the cut 5, with an adhesive component on its surfaces.

The portion of the sheet S into which the connection piece 4 is inserted is compressed in the thickness direction after the insertion of the connection piece 4. In this manner, as illustrated in FIG. 3A, the thickness of the portion of the sheet S into which the connection piece 4 is inserted becomes almost the same as the thickness of the portion of the sheet S into which the connection piece 4 is not inserted. However, a thickness t3 of the insertion part 4*a* of the connection piece 4 can be equal to or less than a half of a thickness t4 of the sheet S, since when the connection piece 4 is thick, the sheet S is expanded in the insertion part 4*a* of the connection piece 4, and a protrusion is generated in a printing surface of the sheet S. In order to secure the strength of the thin connection piece 4, the connection piece 4 includes a base material of a film whose strength is higher than paper. The depth D of the cut 5 in the X direction measured from the side surface 6 of the sheet S is larger than the insertion length of the connection piece 4, i.e., a length d of the insertion part 4*a* in the X direction. This is because, when D=d, the protrusion is generated by the connection piece 4 in a distal end portion of the cut 5, since the cut 5 is formed into the tapered shape. Additionally, in a manufacturing method described later, workability is improved by stopping the insertion of the connection piece 4 before the distal end portion of the cut 5. For the above reasons, the length d of the insertion part 4*a* of the connection piece 4 can be 90% or less of the depth D of the cut 5. On the other hand, when the length d of the insertion part 4*a* is small, the adhesive strength between the connection piece 4 and the sheet S is decreased. Therefore, the length d of the insertion part 4*a* of the connection piece 4 can be 50% or more of the depth D of the cut 5.

A pair of spacers 1*a* and 1*b* are provided on both surfaces of the non-insertion part 4*b* of the connection piece 4. The spacers 1*a* and 1*b* are formed with a paper or a film. The thickness of each of the spacers 1*a* and 1*b* can be equal to or less than a half of the thickness of the sheet S, since a gap is easily generated between the pages on both sides when the pages are opened, if the spacers 1*a* and 1*b* are too thick. The pair of spacers 1*a* and 1*b* are formed with a distance from the insertion part 4*a* of the connection piece 4 in the X direction. In this manner, a gap c that is parallel to the side surface 6, and has a predetermined size is provided between the sheet S and the spacers 1*a* and 1*b*. This portion is an exposed portion of the connection piece 4 in which neither the sheet S nor the spacers 1*a* and 1*b* are provided, and forms a flexible hinge 4*c* of the connection piece 4. Since the hinge 4*c* is easily bent than the sheet S, when the bookbinding article B is opened as illustrated in FIG. 1B, the pages on the left and right sides become flat, which allows so-called lay-frat bookbinding.

As illustrated in FIG. 2B and FIG. 3A, since bonding surfaces are exposed in the area (the hinge 4*c*) of the connection piece 4 between the sheet S and the spacers 1*a* and 1*b*, the connection pieces 4 may stick to each other, or the connection pieces 4 may stick to the sheets S at the time of bookbinding. Therefore, the adhesive force of the area (the hinge 4*c*) of the connection piece 4 in which the gap c is formed can be smaller than the adhesive force of the other areas. The adhesive force is adjustable by making particles adhere to the bonding surfaces, or by using the connection piece 4 in which an adhesive is not applied in advance to the area used as the hinge 4*c*.

The size of the gap c between the sheet S and the spacers 1*a* and 1*b*, i.e., the length of the hinge 4*c* in the X direction, is different for each sheet S. That is, as illustrated in FIG. 1A and FIG. 1B, in the state where a back cover of the bookbinding article B faces down, the bottom end portions of the sheets S form a gently-sloping mountain-like shape in which the sheets S in the center are higher than the sheet S closer to the cover 3. The upper ends of the spacers 1*a* and 1*b* are located at almost the same height for each sheet S. Assuming that the lengths of the hinges 4*c* are H1, H2 and H3 (H3>H2>H1) for sheets S1, S2 and S3 in this order from the outer side, the differences in the lengths (H3−H2), (H2−H1) of the hinges of the sheets S adjacent to each other can be equal to or more than the thickness of the sheet S. On the other hand, the differences in the lengths (H3−H2), (H2−H1) of the hinges can be minimized, since the gap c between pages is increased when the differences in the lengths of the hinges are great. By adjusting the lengths of the hinges, facing portions become substantially flat no matter which pages are opened. Additionally, the continuity of two facing pages is not lost. Although FIG. 1B illustrates the cross section in which the central pages are opened, when the viewer supports the cover 3 by hands, a gap G1 between the facing portions can be made small, and will be substantially flat, no matter which pages are opened. The lengths of the hinges can be changed according to at least one of parameters, i.e., the number of the sheets S to be book-bound, the thickness of a laminate obtained by bundling the sheets S, or the thickness of the sheet S. The larger the number of the sheets S to be bound, the thickness of the laminate, and the thickness of the sheet S are, the longer the lengths of the hinges can be. In order to provide differences between the lengths of the hinges, the lengths of the spacers 1*a* and 1*b* may be changed, or the relative position of the spacers 1*a* and 1*b* may be changed.

With the configuration as described above, since the connection piece 4 does not overlap with the surface of a print image, the uniform surface property is achieved, and visual discomfort is not felt. Additionally, the visual continuity and the sense of unity of two facing pages are improved.

Manufacturing Method of Bookbinding Article B According to First Embodiment

A manufacturing method of the bookbinding article B according to the first embodiment will be described. First, for bookbinding, the sheets S are processed by a method for processing a sheet described below, and then, the processed sheets S are book-bound. Since the bookbinding method is the same as the conventional method, the method for processing the sheet S will be mainly described here.

Figure 4A:
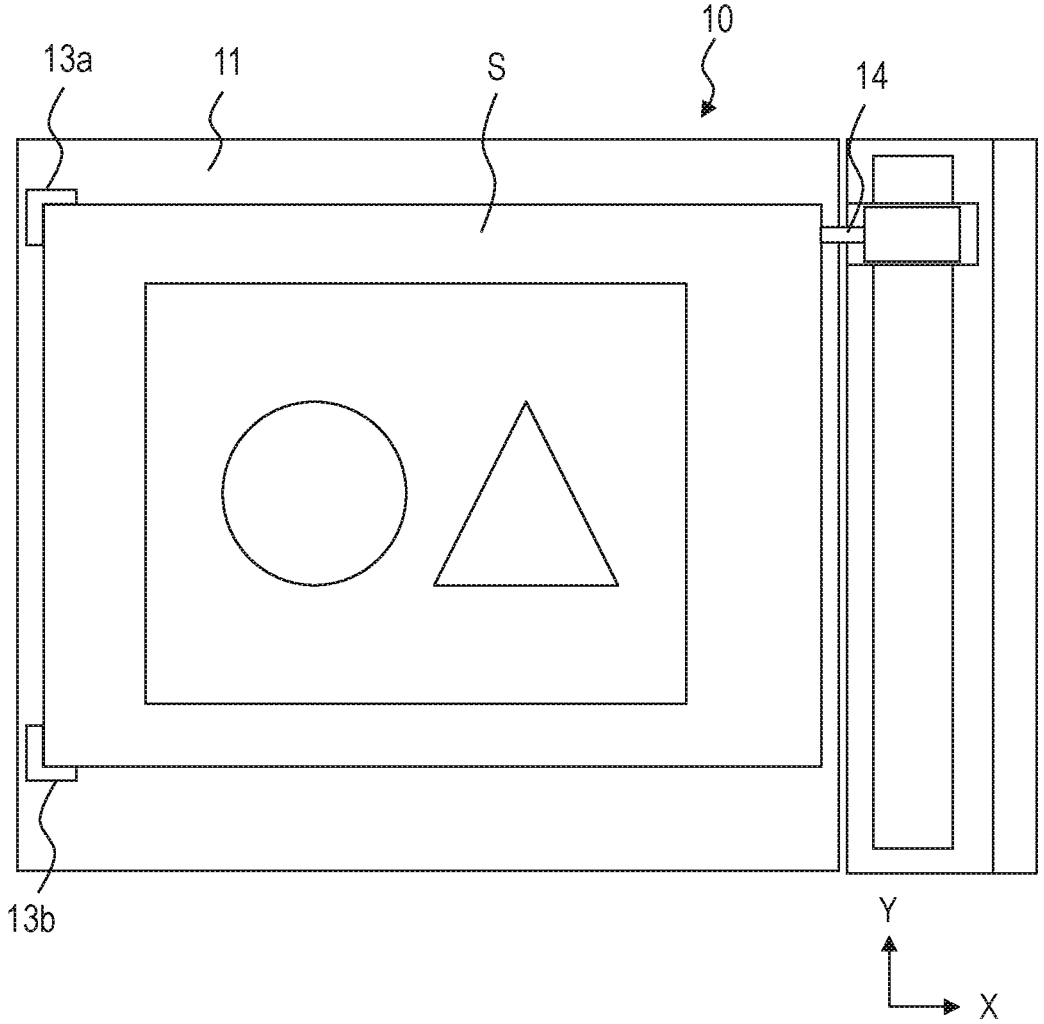
FIG. 4A is a schematic diagram of a cutting apparatus used for manufacturing the sheet illustrated in FIG. 1A and FIG. 1B.
Figure 4B:
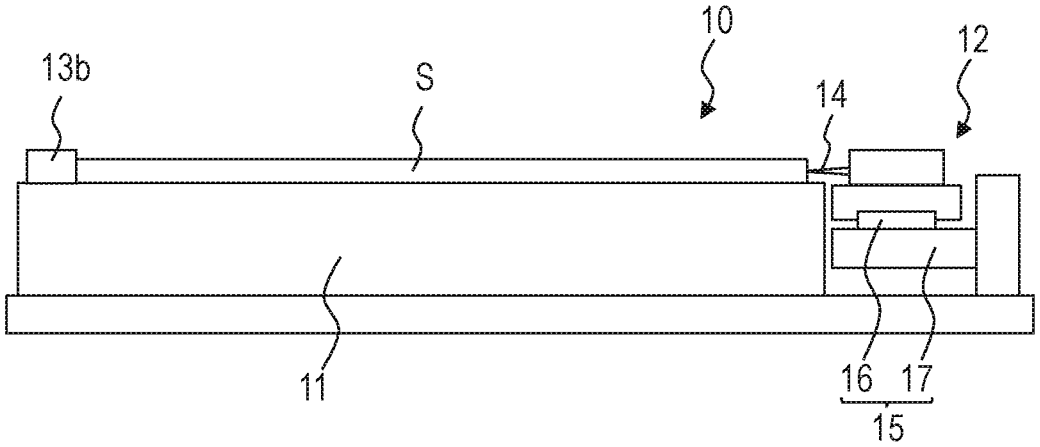
FIG. 4B is a schematic diagram of a cutting apparatus used for manufacturing the sheet illustrated in FIG. 1A and FIG. 1B.

First, the cut 5 is formed in the side surface 6 of the sheet S into which the connection piece 4 is inserted, i.e., the side surface 6 on the side of the spacers 1*a* and 1*b*, by a cutting apparatus 10. FIG. 4A and FIG. 4B illustrate a top view and a side view of the cutting apparatus 10, respectively. The cutting apparatus 10 includes a retaining stand 11 that positions and retains the sheet S, and a cutter unit 12. L-shaped plates 13*a* and 13*b* for positioning are provided on the retaining stand 11, and the sheet S is abutted against and positioned by the L-shaped plates 13*a* and 13*b*. The sheet S is retained on the retaining stand 11 in a proper method. The method of retaining the sheet S is not limited, and a method of charging the retaining stand 11 to retain the sheet S with static electricity, or a method of producing a plurality of micropores in the retaining stand 11, and adsorbing and retaining the sheet S with a negative pressure, etc. can be used. The cutter unit 12 includes a cutter 14 that forms the cut 5 in the side surface 6 of the sheet S, and a cutter retaining part 15 that retains the cutter 14. The distal end of the cutter 14 is tapered, and the other portion (a general portion) has a constant cross section. The cutter retaining part 15 can move the cutter 14 along the thickness direction of the sheet S, and the direction (the Y direction) parallel to the side surface 6 of the sheet S. The cutter retaining part 15 includes a slide unit 16 that moves the cutter 14 in the Y direction, and a lifting stand 17 that adjusts the position of the of cutter 14 in the thickness direction of the sheet S. The height of the lifting stand 17 is adjusted so that the tip of the cutter 14 is located in the middle of the thickness direction of the sheet S. The cut 5 can be formed by abutting the cutter 14 against the sheet S, and sliding the slide unit 16 along the side surface 6 of the sheet S in the Y direction. The thickness of the general portion of the cutter 14 can be equal to or less than the thickness of the sheet S, since if the cutter 14 is thick, a printing surface is easily bent at the time of formation of the cut 5.

Figure 5:
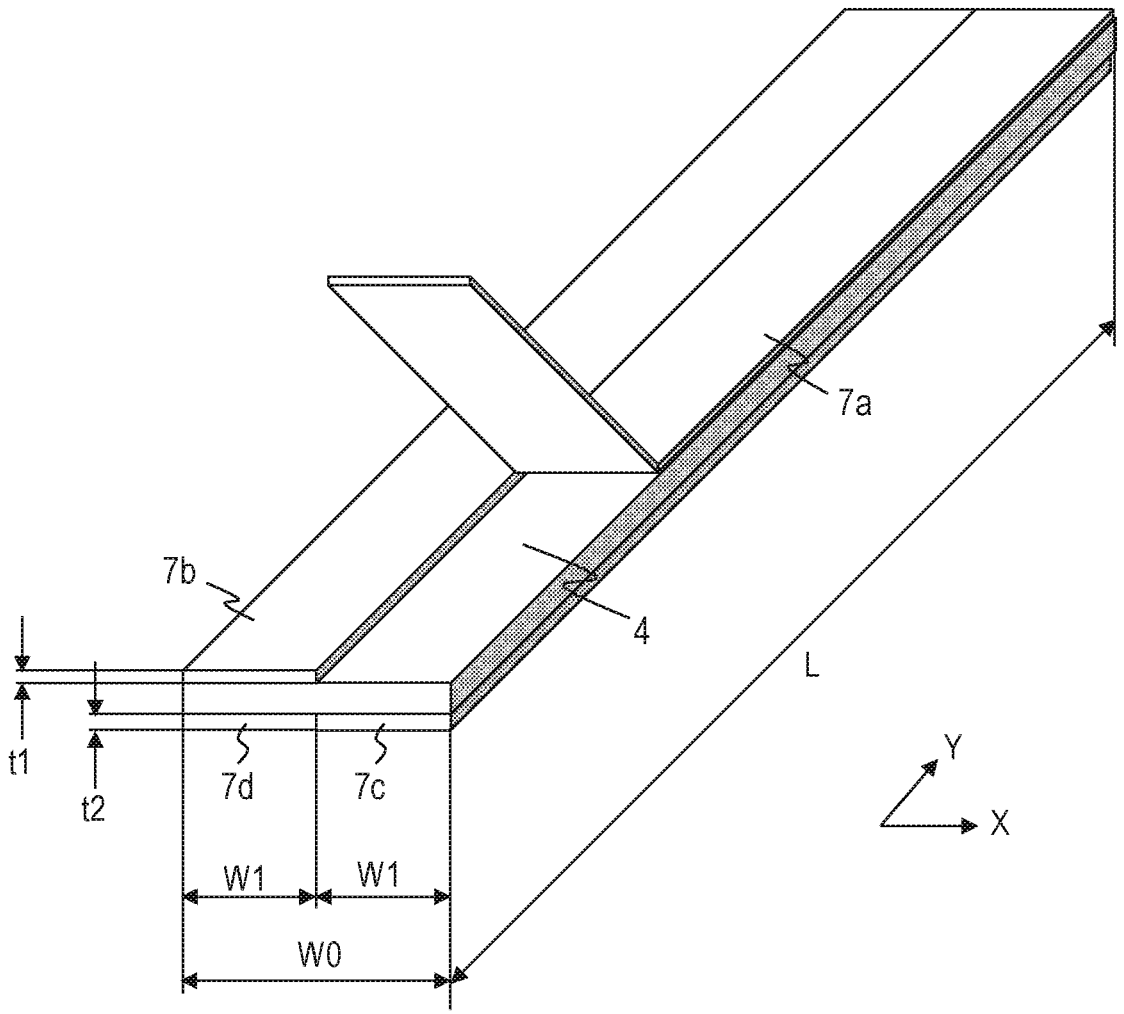
FIG. 5 is a schematic diagram of a double-sided tape used for manufacturing the sheet illustrated in FIG. 1A and FIG. 1B.

FIG. 5 illustrates a perspective view of the connection piece 4. First to fourth release papers 7*a* to 7*d*, which can be individually removed, are applied on both surfaces of the connection piece 4. The first and second release papers 7*a* and 7*b* are provided on one surface 4*d* (see FIG. 6B), which is an upper surface, of the connection piece 4, so as to be separable from each other in the width direction X. The third and fourth release papers 7*c* and 7*d* are provided on the other surface 4*e* (see FIG. 6B), which is a lower surface, of the connection piece 4, so as to be separable from each other in the width direction X. A width W1 of the first to fourth release papers 7*a* to 7*d* in the X direction is ½ of a width W0 of the connection piece 4 in the X direction. A thickness t1 of the first and second release papers 7*a* and 7*b* is thinner than a thickness t2 of the third and fourth release papers 7*c* and 7*d* (t1<t2).

Figure 6A:
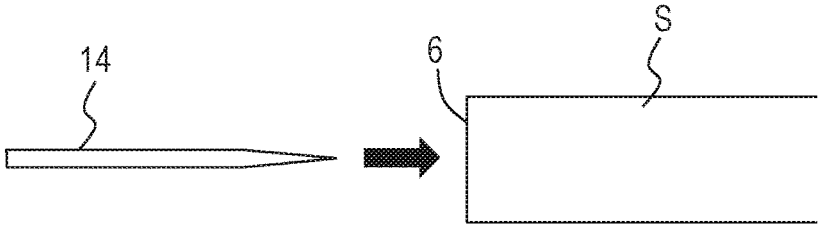
FIG. 6A is a cross-sectional view illustrating a manufacturing method of the sheet illustrated in FIG. 1A and FIG. 1B.
Figure 6B:
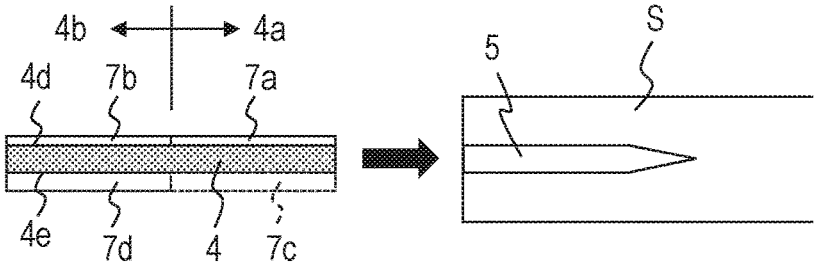
FIG. 6B is a cross-sectional view illustrating the manufacturing method of the sheet illustrated in FIG. 1A and FIG. 1B.
Figure 6C:
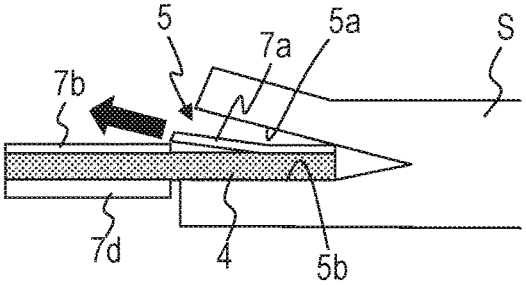
FIG. 6C is a cross-sectional view illustrating the manufacturing method of the sheet illustrated in FIG. 1A and FIG. 1B.
Figure 6D:
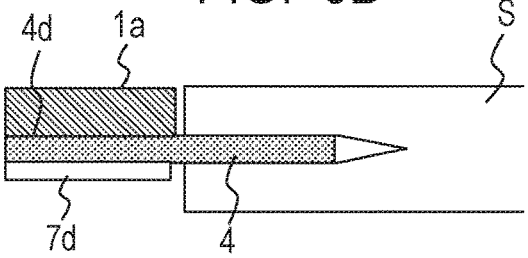
FIG. 6D is a cross-sectional view illustrating the manufacturing method of the sheet illustrated in FIG. 1A and FIG. 1B.

FIG. 6A to FIG. 6E illustrate a procedure of processing the sheet S for bookbinding, i.e., a procedure of inserting the connection piece 4 into the cut 5 of the sheet S, and forming the spacers 1*a* and 1*b*. First, as illustrated in FIG. 6A, the cutter 14 cuts and is inserted into the side surface 6 of the sheet S, and the cut 5 is formed over the entire length of the side surface 6 in the Y direction. Next, as illustrated in FIG. 6B and FIG. 6C, the third release paper 7*c* is released, and one portion (the insertion part 4*a*) of the connection piece 4 is inserted into the cut 5 of the sheet S. The upper surface of the sheet S may be sucked to extend the opening of the cut 5, so that the connection piece 4 can be easily inserted into the cut 5. Since the third release paper 7*c*, which is thicker than the first release paper 7*a*, has been released, the insertion of the connection piece 4 into the cut 5 becomes easy. Additionally, since the first release paper 7*a* remains, the rigidity of the insertion part 4*a* is easily secured. Since the second release paper 7*b* and the fourth release paper 7*d* remain, it is also easy to prevent bending and deflection of the connection piece 4 at the time of insertion of the connection piece 4 into the cut 5.

Next, as illustrated in FIG. 6C, the first release paper 7*a* is released, the cut 5 is closed by pressing down the sheet S from above, and the connection piece 4 is joined to the cut surfaces 5*a* and 5*b* on both sides of the cut 5. Next, the second release paper 7*b* is released, and as illustrated in FIG.

Figure 6E:
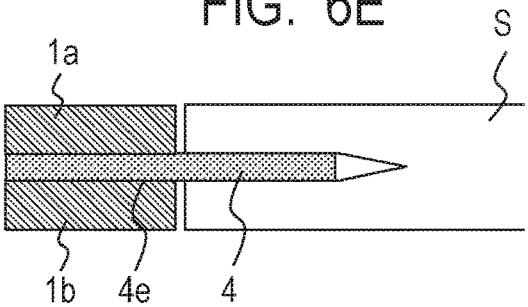
FIG. 6E is a cross-sectional view illustrating the manufacturing method of the sheet illustrated in FIG. 1A and FIG. 1B.

6D, the spacer 1*a* is stuck on one surface 4*d* of the non-insertion part 4*b* of the connection piece 4. Further, as illustrated in FIG. 6E, the fourth release paper 7*d* is removed, and the spacer 1*b* is stuck on the other surface 4*e* of the non-insertion part 4*b* of the connection piece 4. That is, the second release paper 7*b* and the fourth release paper 7*d* of the non-insertion part 4*b* are released after inserting the connection piece 4, and before forming the spacers 1*a* and 1*b*. The order of sticking the spacers 1*a* and 1*b* may be reversed. In this manner, the processing for bookbinding the sheet S is completed. The above process is performed on a plurality of sheets S to be processed, the non-insertion parts 4*b* of the plurality of processed sheets S, the spacers 1*a* and 1*b*, and the endpapers 2*a* and 2*b* are bound, the cover 3 is attached, and the endpapers 2*a* and 2*b* are bonded to the cover 3, thereby completing the bookbinding article B.

Second Embodiment

Figure 7A:
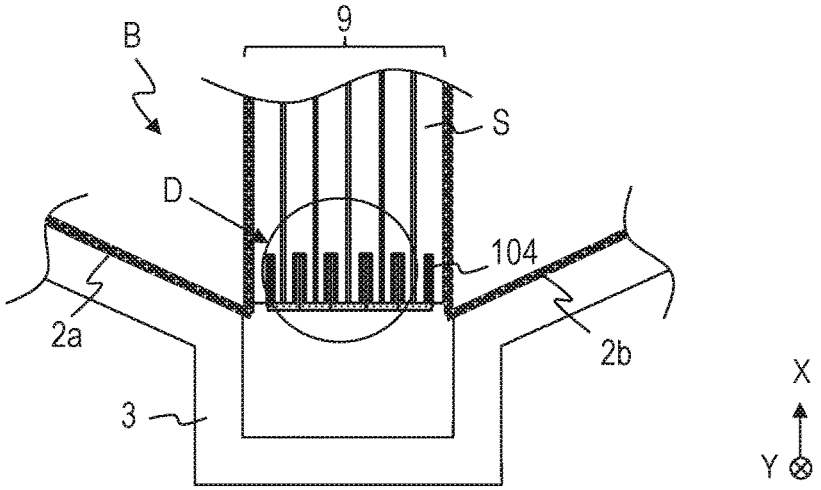
FIG. 7A is a configuration schematic diagram of a bookbinding article according to a second embodiment of the present disclosure.
Figure 7B:
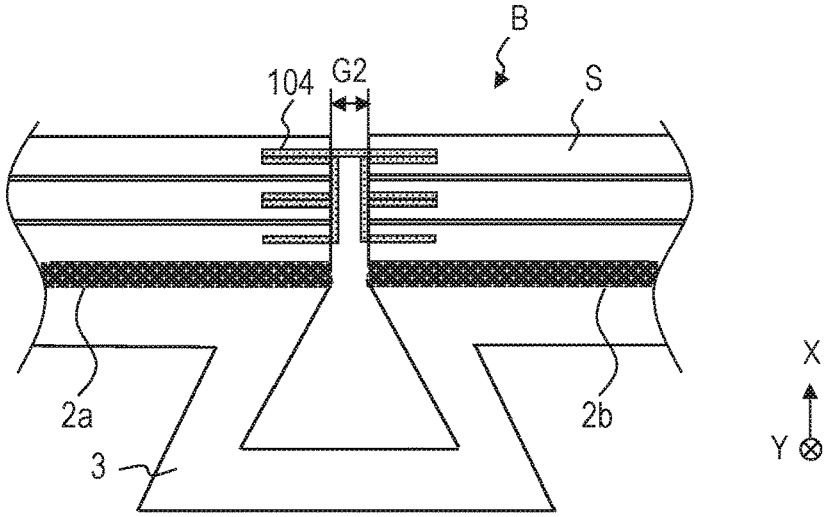
FIG. 7B is a configuration schematic diagram of the bookbinding article according to the second embodiment of the present disclosure.
Figure 7C:
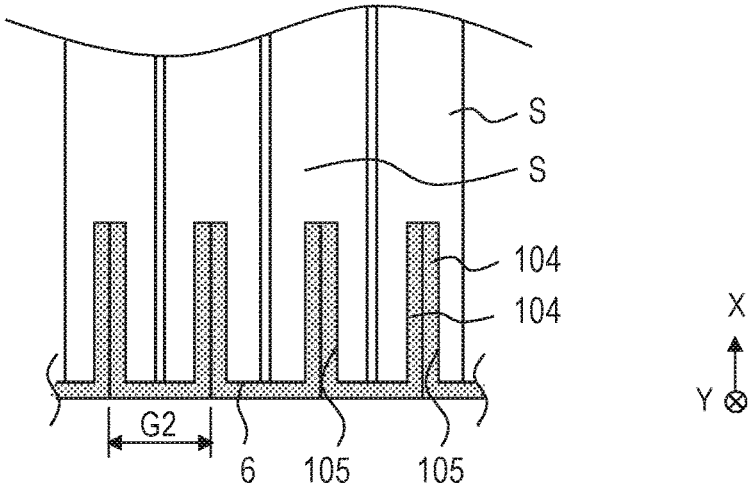
FIG. 7C is a configuration schematic diagram of the bookbinding article according to the second embodiment of the present disclosure.

A second embodiment of the present disclosure will be described. Here, the points different from the first embodiment will be mainly described. The points whose descriptions are omitted are the same as those of the first embodiment. FIG. 7A to FIG. 7C are cross-sectional views of the bookbinding article B according to the second embodiment of the present disclosure, which is illustrated in the state where the back cover of the bookbinding article B faces down. FIG. 7A illustrates the state where the bookbinding article B is closed, and FIG. 7B illustrates the state where the bookbinding article B is opened. FIG. 7C is an enlarged view of a section D in FIG. 7A, and illustrates the connection piece in an enlarged manner. As illustrated in FIG. 7C, a cut 105 is formed in the binding-side side surface 6 of the sheet S, as in the first embodiment. However, different from the first embodiment, one portions of two connection pieces 104 are inserted into the cuts 105. The other portion of each of the connection pieces 104 is inserted into the cut 105 of another sheet S adjacent on either side, respectively. That is, two sheets S adjacent to each other are connected or coupled to each other by one connection piece 104. In the present embodiment, the connection piece 104 is used in order to join one sheet S to another adjacent sheets S. The center portion of each connection piece 104 exposed outside the sheet S may or may not be joined to the side surface 6 of the sheet S. The positions of the binding-side bottom ends of the sheets S are aligned with other sheets S. As illustrated in FIG. 7A, only one connection piece 104 is inserted into the cuts of the sheets S that serve as the first page and the last page at the time of bookbinding.

Half portions of the endpapers 2*a* and 2*b* are bonded to the sheets S serving as the first and last pages with a method, such as an adhesive and an adhesive tape, and the other half portions of the endpapers 2*a* and 2*b* are joined to the cover 3 in the same method. Since the connection pieces 104 are easily bent than the sheets S, when the bookbinding article B is opened, the connection piece 104 are bent. In this manner, when the bookbinding article B is opened, the pages on the left and right sides become flat, and the so-called lay-frat bookbinding is allowed.

Compared with the first embodiment, in the second embodiment, the gap between the left and right pages at the time when the bookbinding article B is opened can be made smaller. In the first embodiment, when the bookbinding article B is opened, the left and right pages can be made flat since the hinges 4*c* are bent, but at this time, two hinges 4*c* are located between the left and right pages, and are recognized as a part of the gap between the pages by the viewer. Accordingly, a gap G1 between the pages in the first embodiment is (the array pitch between the sheet S (the hinge 4*c*)+the thickness of the connection piece 4+the deformation amount of the hinge 4*c*). On the other hand, since a gap G2 between the pages in the second embodiment is the length of the connection piece 104 connecting the left and right pages as illustrated in FIG. 7B, i.e., the pitch between the sheets S, G1>G2 is established.

With the configuration as described above, since the connection piece 104 does not overlap with the surface of a print image, the uniform surface property is achieved, and visual discomfort is not felt. Additionally, the visual continuity and the sense of unity of two facing pages are improved.

Manufacturing Method of Bookbinding Article B According to Second Embodiment

A manufacturing method of the bookbinding article B according to the second embodiment will be described with reference to FIG. 8A to FIG. 8E. Also in this embodiment, first, for bookbinding, the sheets S are processed by the method for processing a sheet, and then, the processed sheets S are book-bound. Since the bookbinding method is the same as the conventional method, the method for processing the sheet S will be mainly described here. Since a plurality of sheets are mentioned in the following description, the sheets serving as first to third pages when a book is bound are called first to third sheets S101 to S103, and cuts of the first to third sheets S101 to S103 are called first to third cuts 105*a* to 105*c*, respectively. The connection piece inserted into the first and second cuts 105*a* and 105*b* is called a first connection piece 104*a*, and the connection piece inserted into the second and third cuts 105*b* and 105*c* is called a second connection piece 104*b*. The connection piece secondly inserted into the third cut 105*c* is called a third connection piece 104*c*. The first to third connection pieces 104*a* to 104*c* are the same as the connection pieces 4 in the first embodiment, and are provided with the four release papers as illustrated in FIG. 5.

Figure 8A:
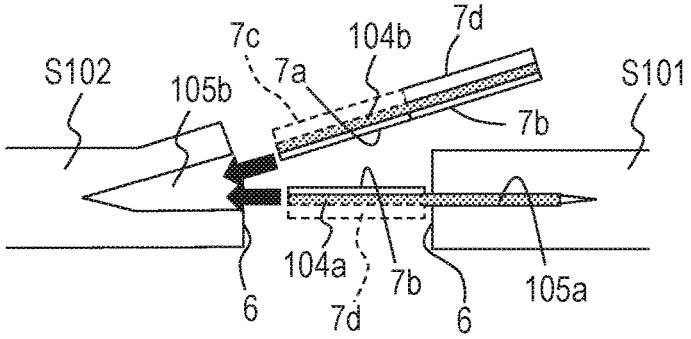
FIG. 8A is a cross-sectional view illustrating a manufacturing method of the sheet illustrated in FIG. 7A to FIG. 7C.

First, as illustrated in FIG. 8A, the first cut 105*a* is formed in the side surface 6 of the first sheet S101. Next, one portion of the first connection piece 104*a* is inserted into the first cut 105*a*. Next, the first cut 105*a* is closed, and the first connection piece 104*a* is joined to the first sheet S101. The process so far is performed in the same manner as in the first embodiment. In this manner, the processing of the first sheet S101 is completed.

Next, the second cut 105*b* is formed in the side surface 6 of the second sheet S102 with the same method as in the first embodiment. Then, the first connection piece 104*a* from which the fourth release paper 7*d* is removed, and the second connection piece 104*b* from which only the third release paper 7*c* is removed are simultaneously inserted into the second cut 105*b* in the state where the side surface 6 of the second sheet S102 is opposed to the side surface 6 of the first sheet S101. That is, the other portion of the first connection piece 104*a* and one portion of the second connection piece 104*b* are inserted into the second cut 105*b* of the second sheet S102. Additionally, since the second release paper 7*b* of the first connection piece 104*a*, and the first release paper 7*a* of the second connection piece 104*b* are left, wrinkles and bending can be prevented from being generated when the first connection piece 104*a* and the second connection piece 104*b* are inserted, and these contact with each other. Note that each connection piece is connected so that the gap G2 having a predetermined interval remains to form a hinge between the first sheet S101 and the second sheet S102 in the book-bound state.

Figure 8B:
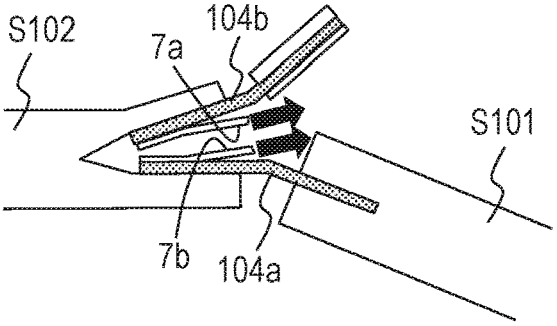
FIG. 8B is a cross-sectional view illustrating the manufacturing method of the sheet illustrated in FIG. 7A to FIG. 7C.

Next, as illustrated in FIG. 8B, the second release paper 7*b* of the first connection piece 104*a*, and the first release paper 7*a* of the second connection piece 104*b* are released, the second sheet S102 is pushed down from above, and the second cut 105*b* is closed. The first connection piece 104*a* is joined to one surface of the second cut 105*b*, and the second connection piece 104*b* is joined to the other surface and, further, the first connection piece 104*a* and the second connection piece 104*b* are joined to each other. In this manner, the processing of the second sheet S102 is completed.

Figure 8C:
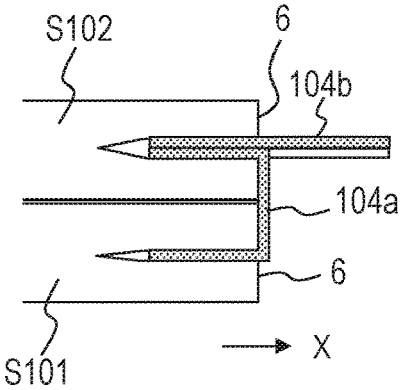
FIG. 8C is a cross-sectional view illustrating the manufacturing method of the sheet illustrated in FIG. 7A to FIG. 7C.
Figure 8D:
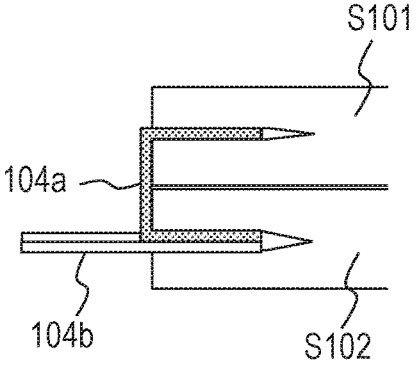
FIG. 8D is a cross-sectional view illustrating the manufacturing method of the sheet illustrated in FIG. 7A to FIG. 7C.
Figure 8E:
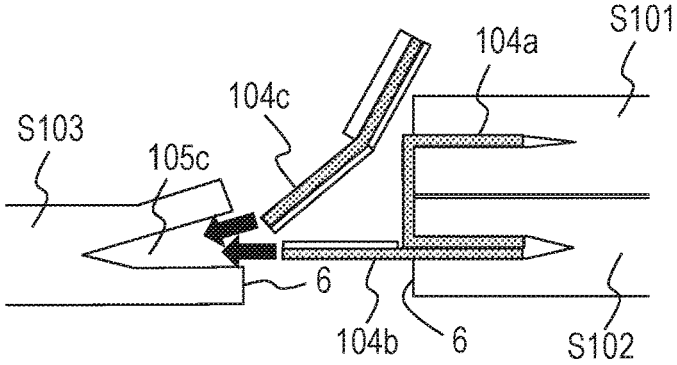
FIG. 8E is a cross-sectional view illustrating the manufacturing method of the sheet illustrated in FIG. 7A to FIG. 7C.

Next, as illustrated in FIG. 8C, the first sheet S101 is relatively rotated and folded with respect to the second sheet S102. Although the first sheet S101 is rotated and folded with respect to the second sheet S102 in the illustrated example, the second sheet S102 may be rotated and folded with respect to the first sheet S101. The first connection piece 104*a* is changed into a generally U-shape, and the side surface 6 of the first sheet S101 and the side surface 6 of the second sheet S102 are located on the same surface. At this time, when necessary, the relative position of the first sheet S101 or the second sheet S102 in the X direction may be adjusted, so as to eliminate slack of the first connection piece 104*a*. The first connection piece 104*a* may be pressed against the side surface 6 of the first sheet S101 and the side surface 6 of the second sheet S102. Next, as illustrated in FIG. 8D, the first sheet S101 and the second sheet S102 are rotated by 180 degrees, so that the first sheet S101 comes on top of the second sheet S102. Thereafter, the third cut 105*c* is formed in the side surface 6 of the third sheet S103. Then, the other portion of the second connection piece 104*b*, and one portion of the third connection piece 104*c* are inserted into the third cut 105*c* in the state where the side surface 6 of the third sheet S103 is opposed to the side surface 6 of the second sheet S102. Thereafter, a laminate 9 (see FIG. 7A) of the sheets joined to each other with the connection pieces is formed by repeating the processes illustrated in FIG. 8C to FIG. 8E. Finally, bookbinding is completed by attaching the endpapers 2*a* and 2*b* and the cover 3 to the laminate 9.

EXAMPLES

Sheets used in Example 1 and Example 2 are common, and double-sided photographic sheets having the A5 size and a thickness of 240 μm were used. The cut 5 was formed in the long side of a sheet using the cutting apparatus 10 illustrated in FIG. 4A and FIG. 4B. The thickness of the cutter 14 of the cutting apparatus 10 was set to be 0.2 mm, and the depth D of the cut 5 was set to 8 mm A 6-page bookbinding was performed in both Example 1 and Example 2.

Example 1

A specific example of the first embodiment will be described as Example 1. Here, six sheets were processed for bookbinding, and bookbinding was performed. The connection piece 4 included an acrylic adhesive on a base material of polyester film. The thickness t3 of the connection piece 4 was 60 μm, a length L (see FIG. 5) was 210 mm, the adhesive force was 12N/25 mm, and the shear bond strength was 340N/4 $cm^2$. The width W0 of the connection piece 4 differed depending on the page. The width W0 of the connection piece 4 of the sheets serving as a first page and a sixth page was 10.2 mm, the width W0 of the connection piece 4 of the sheets serving as a second page and a fifth page was 10.45 mm, the width W0 of the connection piece 4 of the sheets serving as a third page and a fourth page was 10.7 mm. As illustrated in FIG. 5, the release paper of the connection piece 4 was divided into four, the thickness t1 of the first and second release papers 7*a* and 7*b* was 20 μm, and the thickness t2 of the third and fourth release papers 7*c* and 7*d* was 50 μm. High-quality papers having a thickness of 100 μm and a width of 5 mm were used for the spacers 1*a* and 1*b*.

The cut 5 having a length of 8 mm was formed in each sheet, and the connection piece 4 was inserted into the cut 5 at the depth of 5 mm. The spacers 1*a* and 1*b* were stuck so that the end faces on the opposite side of the sheet were aligned. The width of the hinge 4*c* differed depending on the page: 0.2 mm for the first page and the sixth page; 0.45 mm for the second page and the fifth page; and 0.7 mm for the third page and the fourth page. In order to reduce the adhesive force of the bonding surfaces of the connection piece 4 exposed in the portion of the hinge 4*c*, a baby powder having a particle diameter of 10 to 30 μm was made to adhere to the bonding surfaces. The bookbinding was performed by sandwiching the processed sheets for six pages between the endpapers 2*a* and 2*b*, which were the high-quality papers having a thickness of 100 mm, and after staple binding these, attaching the hardcover 3 having a thickness of 6 mm to these, and gluing the endpapers 2*a* and 2*b* and the cover 3 to each other.

Example 2

A specific example of the second embodiment will be described as Example 2. Here, six sheets were processed for bookbinding, and bookbinding was performed. The connection piece 104 included an acrylic adhesive on a base material of polyester film. The thickness t3 of the connection piece 104 was 30 μm, the width W0 was 10.25 mm, the length L was 210 mm, the adhesive force was 13N/25 mm, and the shear bond strength was 380N/4 $cm^2$. As illustrated in FIG. 5, the release paper of the connection piece 104 was divided into four, and the thickness of the release paper was the same as that in Example 1. The cut 5 having a length of 8 mm was formed in each sheet, and the connection piece 104 was inserted into the cut 5 at the depth of 5 mm. The bookbinding was performed by gluing the endpaper 2*a*, which is made of the high-quality paper having a thickness of 100 μm, to the first page of the laminate of sheets including six pages, and gluing the endpaper 2*b* of the same material and having the same thickness to the sixth page, and gluing the hardcover 3 to each of the endpapers 2*a* and 2*b*.

According to the present disclosure described above, since the connection piece is inserted into the cut of the binding-side side surface of a sheet, the method for processing a sheet and the bookbinding article can be provided with which a tape is not visually recognized to overlap with a print image on a surface of the sheet. Additionally, according to the present disclosure, the method for processing a sheet and the bookbinding article that can improve the visual continuity and the sense of unity of print image over two facing pages can be provided.

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may include one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read-only memory (ROM), a storage of distributed computing systems, an optical disk (such as a compact disc (CD), digital versatile disc (DVD), or Blu-ray Disc (BD)™), a flash memory device, a memory card, and the like.

While the present disclosure has been described with reference to exemplary embodiments, it is to be understood that the disclosure is not limited to the disclosed exemplary embodiments.

This application claims the benefit of Japanese Patent Application No. 2019-097663, filed May 24, 2019, and Japanese Patent Application No. 2020-044257, filed Mar. 13, 2020, which are hereby incorporated by reference herein in their entirety.

What is claimed is:

1. A method for processing a sheet for bookbinding, the method comprising:

forming a cut that divides a thickness of the sheet in a binding-side side surface of the sheet;

inserting, into the cut, a portion of a connection piece that is attached to the sheet and functions as a hinge in a book-bound state; and joining, to the sheet, the portion of the connection piece inserted into the cut, wherein the cut is formed by a cutter as a slit-shaped cut along the binding-side side surface with a predetermined depth, and wherein the slit-shaped cut divides the thickness of the sheet into two in the binding-side side surface of the sheet, where the sheet is retained on a retaining stand.

2. The method according to claim 1, wherein inserting includes inserting the portion of the connection piece into the cut so that the connection piece portion takes up between 50% to 90% of a depth of the cut.

3. The method according to claim 1, wherein the connection piece includes a film base material.

4. The method according to claim 1, wherein a portion of a single connection piece is inserted into the cut of the sheet, wherein the portion of the single connection piece has two surfaces, each have adhesive properties, and wherein the portion of the single connection piece is joined to the sheet by closing the cut so as to bring the sheet and the portion of the single connection piece into contact with each other.

5. The method according to claim 1, wherein the connection piece has surfaces and is provided with a spacer member on each surface of the connection piece at a predetermined distance, from the inserted portion of the connection piece.

6. The method according to claim 5, wherein adhesive force of the connection piece in a zone between the inserted portion of the connection piece and the spacer members is smaller than adhesive force of another area.

7. The method according to claim 5, wherein a thickness of a spacer member is equal to or less than half of the thickness of the sheet, and a combined thickness of the spacer members and the connection piece is substantially the same as the thickness of the sheet, in a state where one of the spacer members is attached to each surface of the connection piece.

8. The method according to claim 1, wherein forming the cut includes forming a first cut in a first side surface of a first sheet and includes forming a second cut in a second side surface of a second sheet, wherein inserting the portion of the connection piece into the cut includes inserting one portion of a first connection piece into the first cut of the first sheet, and inserting another portion of the first connection piece into the second cut of the second sheet, and wherein joining the portion of the connection piece includes (i) joining the one portion of the first connection piece inserted into the first cut to the first sheet by closing the first cut of the first sheet, and (ii) joining the other portion of the first connection piece inserted into the second cut to the second sheet by closing the second cut of the second sheet.

9. The method according to claim 8, wherein the first connection piece has a gap of a predetermined length between the portion of the connection piece joined to the first sheet and another portion of the connection piece joined to the second sheet, the method further comprising superposing the first sheet and the second sheet on each other by folding the first sheet and the second sheet at the gap.

10. The method according to claim 9, further comprising:

inserting the portion of the connection piece into the cut such that one portion of a second connection piece is inserted into the second cut of the second sheet together with the other portion of the first connection piece, wherein, in joining the portion of the connection piece to the sheet, the other portion of the first connection piece and the one portion of the second connection piece inserted into the second cut of the second sheet are joined to the second sheet; and superposing the first sheet and the second sheet on each other after inserting the portion of the connection piece into the cut.

11. The method according to claim 10, further comprising:

creating, by repeating the method according to claim 10, a laminate of a plurality of sheets in which sheets of the plurality of sheets adjacent to each other are coupled with the connection piece; and attaching a cover to the laminate of the plurality of sheets as a bookbinding article.

12. A bookbinding method comprising:

performing the method according to claim 1, wherein the connection piece has surfaces and is provided with a spacer member on each surface of the connection piece at a predetermined distance from the inserted portion of the connection piece, and wherein adhesive force of the connection piece in a zone between the inserted portion of the connection piece and the spacer members is smaller than adhesive force of another area; and bundling and binding, with a cover, thea plurality of processed sheets at portions of the spacer members.

13. A bookbinding method comprising:

performing the method according to claim 1, 1 wherein the connection piece has surfaces and is provided with a spacer member on each surface of the connection piece at a predetermined distance from the inserted portion of the connection piece, and wherein a thickness of a spacer member is equal to or less than half of the thickness of the sheet, and a combined thickness of the spacer members and the connection piece is substantially the same as the thickness of the sheet, in a state where one of the spacer members is attached to each surface of the connection piece; and bundling and binding, with a cover, a plurality of processed sheets at portions of the spacer members.

14. A bookbinding article comprising:

a plurality of sheets, each having a cut in a side surface; and a connection piece having a non-insertion part that includes surfaces, wherein a portion of the connection piece is inserted into the cut of each sheet and joined to each sheet, and wherein the plurality of sheets are bound to each other via the connection piece, wherein one spacer of a pair of spacers is provided on each surface of the non-insertion part of the connection piece, wherein the non-insertion part is not inserted into a sheet, wherein the pair of spacers is provided at a predetermined distance from an insertion part of the connection piece inserted into the sheet, and wherein a plurality of connection pieces and a plurality of pairs of spacers are bound so that they are book-bound and a gap area between the insertion part of the connection piece and the plurality of pairs of spacers form a hinge.

15. The bookbinding article according to claim 14, wherein the connection piece includes a flexible film base material.

16. The bookbinding article according to claim 14, wherein the gap area is adjusted by an array pitch between the plurality of sheets, a thickness of the connection piece, and a deformation amount of the hinge, and a size of the gap area sequentially becomes longer from the gap area between sheets located on both ends of the bookbinding article toward thea sheet located in a center portion of the bookbinding article.

17. The bookbinding article according to claim 14, wherein two connection pieces are inserted into the cut of a first sheet, wherein each connection piece of the two connection pieces is inserted into cuts of separate sheets that are different from the first sheet, and wherein a first gap area exists between the separate sheets attached to both ends of the connection piece such that this first gap area forms a hinge.

18. The bookbinding article according to claim 17, wherein the first gap area is adjusted with an array pitch between the plurality of sheets, and is constant irrespective of positions of the plurality of sheets.

* * * * *